100-93 S?
10/15/85 X- 4,547,255

United States Patent [19]

Yow

[11] Patent Number: 4,547,255

[45] Date of Patent: Oct. 15, 1985

[54] PRESS CONSTRUCTION

[75] Inventor: Larry R. Yow, North Wilkesboro, N.C.

[73] Assignee: Modern Globe, Inc., North Wilkesboro, N.C.

[21] Appl. No.: 660,001

[22] Filed: Oct. 9, 1984

[51] Int. Cl.[4] ..... B30B 15/06

[52] U.S. Cl. ..... 156/580; 100/93 P; 100/232; 100/233; 100/237; 144/242 B; 144/242 K; 156/380.6; 156/559; 156/583.1; 156/583.8; 156/583.9

[58] Field of Search ..... 156/380.6, 558, 559, 156/580, 583.1, 583.8, 583.9, 304.6, 304.1; 100/93 P, 232, 233, 237; 144/242 B, 242 E, 242 A, 242 K

[56] References Cited

U.S. PATENT DOCUMENTS

| | | | |
|---|---|---|---|
| 2,526,342 | 10/1950 | Frisch | 156/380.6 |
| 2,537,918 | 1/1951 | Skoog | 156/558 |
| 3,444,029 | 5/1969 | Renaud et al. | 156/380.6 |
| 4,212,699 | 7/1980 | Braunschweller | 156/559 |

*Primary Examiner*—Michael Wityshyn
*Attorney, Agent, or Firm*—Salter & Michaelson

[57] ABSTRACT

A press for securing a plurality of workpiece elements in substantially coplanar, side-by-side, pressurized engagement during a gluing operation. The press comprises a bed, a retaining wall adjacent one edge of the bed, a plurality of pusher shoes mounted adjacent an opposite edge of the bed, and a top platen which is positionable in substantially parallel, spaced relation to the bed and has a plurality of spaced platen fingers along one edge thereof for receiving the pusher shoes in interfitting relation between the fingers. The press is operable for maintaining a plurality of workpiece elements in substantially coplanar relation between the bed and the top platen, and because the pusher shoes are receivable between the platen fingers, it is simultaneously operable thereto for urging the workpiece elements into pressurized engagement with each other between the pusher shoes and the retaining wall.

5 Claims, 4 Drawing Figures

FIG. 2
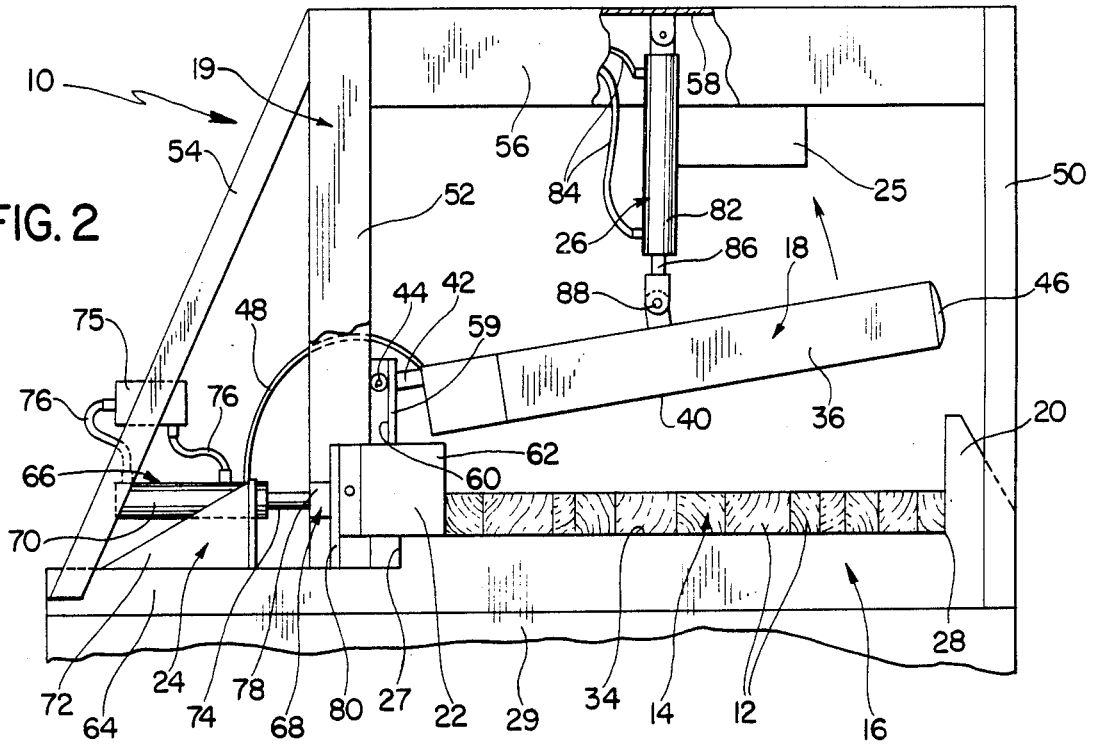
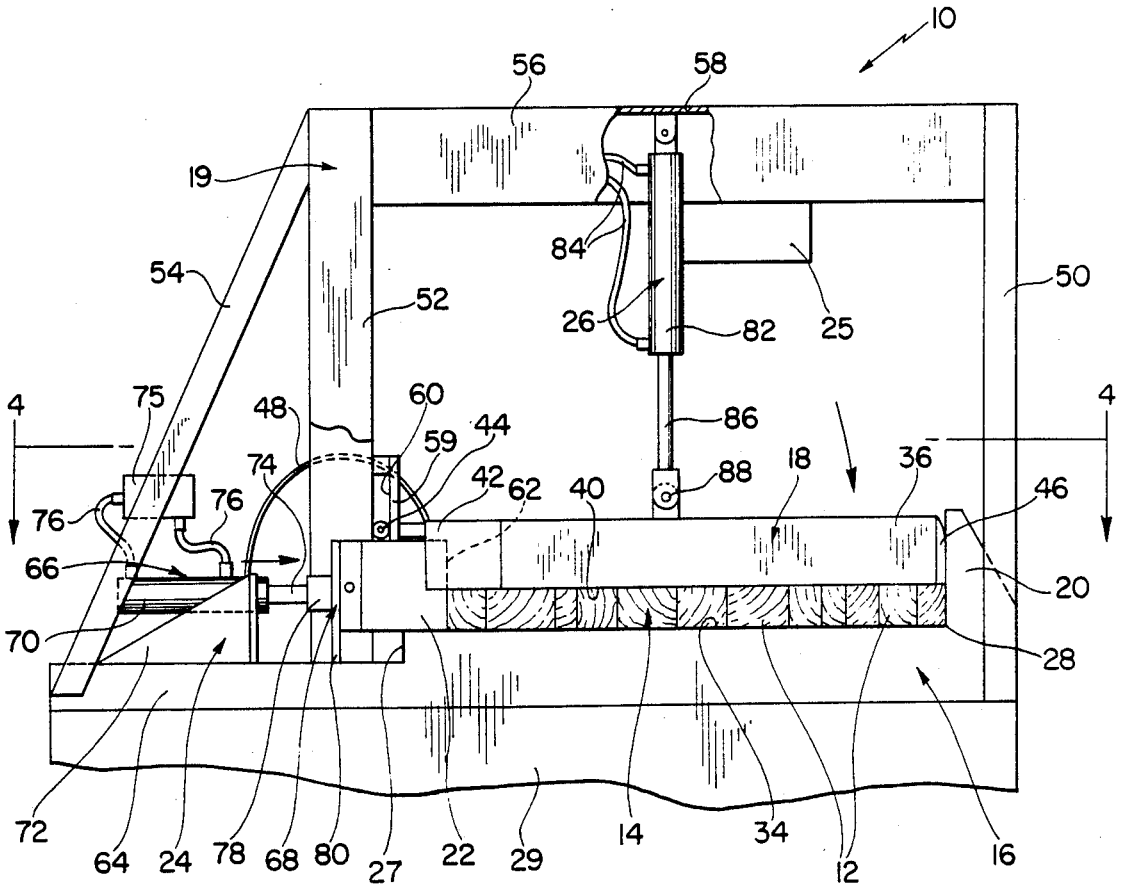
FIG. 3

PRESS CONSTRUCTION

BACKGROUND AND SUMMARY OF THE INVENTION

The instant invention relates to apparatus for use in gluing operations, especially in the woodworking industry, and more particularly, to a press which is operable for securing a plurality of workpiece elements in pressurized engagement during a gluing operation.

A variety of different apparatuses have been utilized in industries, such as the woodworking industry, for securing workpiece elements in pressurized engagement during gluing operations. For commercial applications, large presses have been utilized which are capable of applying downward pressures to workpiece elements to maintain them in substantially coplanar relation while simultaneously applying pressures thereto to urge them into pressurized engagement. Presses of this type are commonly used for gluing operations in the woodworking industry to secure wood strips together to form solid panels, to glue wood bands to cores, to face-glue flat boards together to form solid posts or panels, and to apply veneers to the edges of cores. A large variety of products have been commonly manufactured utilizing apparatus of this type, including butcher block panels, raised panel doors, and many table tops.

The most common type of press heretofore available for use in securing workpiece elements together during gluing operations comprises a substantially flat bed for receiving a plurality of workpiece elements thereon, a top platen which is hingeably connected to the bed so that it is adjustably positionable in substantially parallel relation thereto, and means for applying downward pressure to the top platen to urge it toward the upper surface of the bed. Apparatus of this type further comprises an abutment or retaining wall along one edge of the bed for laterally retaining workpiece elements thereon, a plurality of removable pusher shoes which are disposed adjacent an edge of the bed which is opposite from the abutment, and means for urging the pusher shoes toward the abutment. In apparatus of this type, the pusher shoes generally comprise stacks of relatively thin removable pusher shoe blocks which are receivable on the bed between the top platen and the bed surface so that when the top platen is in pressurized engagement with workpiece elements on the bed, the pusher shoes can be utilized for applying lateral pressures to the workpiece elements to urge them toward the abutment and thereby urge them into pressurized engagement with each other. The pusher shoes of apparatus of this type are adjustable for various thicknesses by adding or removing pusher shoe blocks. However, for use of apparatus of this type, the pusher shoes must be adjusted for each different operation so that the combined thicknesses of the blocks are slightly less than the thickness of the workpiece elements on the bed to allow the pusher shoes to be received between the top platen and the bed so that they urge the workpiece elements on the bed into pressurized engagement with each other.

Presses of the above type which utilize pusher shoes comprising stacked pusher-shoe blocks have been found to have several disadvantages. First, a large inventory of pusher-shoe blocks must be maintained in order to accommodate workpiece elements of various thicknesses. Further, pusher-shoe blocks are not always exactly the same length, so that often when they are stacked on top of each other they define irregular faces for the workpiece elements, which causes the workpiece elements to be pressed unevenly when the press is operated. This often causes the workpiece elements to be glued unevenly, which is generally unsatisfactory for all gluing operations, but particularly so when gluing flat boards together to form solid posts or panels or when applying veneers to the edges of cores. Another disadvantage of presses of the above type is that they require substantial amounts of time to adjust the pusher shoes thereof to accommodate workpiece elements of different thicknesses. Further, it has been found that because the addition or removal of pusher-shoe blocks to adjust a press for workpiece elements of different thicknesses is a relatively time consuming operation, it is frequently forgotten or neglected by operators so that presses are frequently operated with incorrect pusher-shoe thicknesses, and this can also cause uneven pressing.

The press of the instant invention has been developed to overcome the disadvantages of the heretofore-known pressing apparatus, and it generally comprises a bed having a substantially flat bed surface thereon, a plurality of spaced pusher shoes disposed adjacent a first edge of the bed, and means for urging the pusher shoes toward an opposite second edge of the bed. The apparatus further comprises means for laterally retaining workpiece elements on the bed surface against movement toward the second edge of the bed, a top platen which has a substantially flat platen surface thereon and which is positionable so that the platen surface is in substantially parallel face-to-face relation with the bed surface, and means for urging the top platen toward the bed. In contrast to the heretofore-known pressing apparatus, however, the top platen of the press of the instant invention comprises a main portion and a plurality of spaced, substantially parallel platen fingers which extend from an edge of the main portion and which are oriented for receiving the pusher shoes of the press therebetween. The platen surface extends across both the main portion and the platen fingers, and hence both the main portion and the fingers are operative for applying pressures to workpiece elements on the bed surface to urge them toward the bed. In further contrast to the heretofore known presses, the pusher shoes, which are preferably permanently attached to the pusher-shoe urging means, travel between the platen fingers rather than between the platen surface and the bed surface. Hence, the pusher shoes are preferably dimensioned to accommodate workpiece elements having thicknesses which are at least equal to the maximum thickness for which the apparatus is intended, although because the pusher shoes travel between the fingers, the same pusher shoes can also be utilized without adjustments thereto for pressing workpiece elements having smaller thicknesses.

Accordingly, because the apparatus of the instant invention comprises pusher shoes which travel between platen fingers so that they are operative with workpiece elements of various thicknesses, many of the disadvantages of the heretofore-known presses are overcome. Specifically, there is no necessity for maintaining a large inventory of removable pusher-shoe blocks, and the necessity for adjusting the thicknesses of the pusher shoes each time workpiece elements of a different thickness are pressed in the apparatus is eliminated. Further, the pusher shoes always provide even, flat working faces which are engageable with workpiece elements to apply even pressure thereto. As a result of these improvements, the chances for operator error are substantially reduced so that the frequency of producing improperly glued workpiece elements is substantially reduced. In addition, since operators are not required to change pusher-shoe blocks to accommodate workpiece elements of different thicknesses, substantial savings in time are realized when operating the apparatus of the instant invention. Hence, it is seen that the apparatus of the instant invention is capable of producing better-quality products at increased production rates, and therefore the apparatus of the instant invention represents a significant advancement in the art.

Accordingly, it is a primary object of the instant invention to provide a pressing apparatus comprising a bed, a top platen, and a plurality of pusher shoes, wherein the pusher shoes are receivable between platen fingers of the top platen for urging workpiece elements into pressurized engagement with each other.

Another object of the instant invention is to provide an improved apparatus for securing workpiece elements in substantially coplanar, side-by-side pressurized engagement during a gluing operation.

A still further object of the instant invention is to provide an apparatus for securing workpiece elements during a gluing operation wherein the addition or removal of pusher-shoe blocks is not required to accommodate workpiece elements of a different thickness in the apparatus.

An even further object of the instant invention is to provide a press for securing workpiece elements in pressurized engagement during a gluing operation which operates with improved accuracy and efficiency and with reduced setup time.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 2 is a side elevational view of the press with the top platen thereof in an upwardly pivoted position;

FIG. 3 is a similar view with the top platen in a lowered or operative position.

DESCRIPTION OF THE INVENTION

Figure 1:
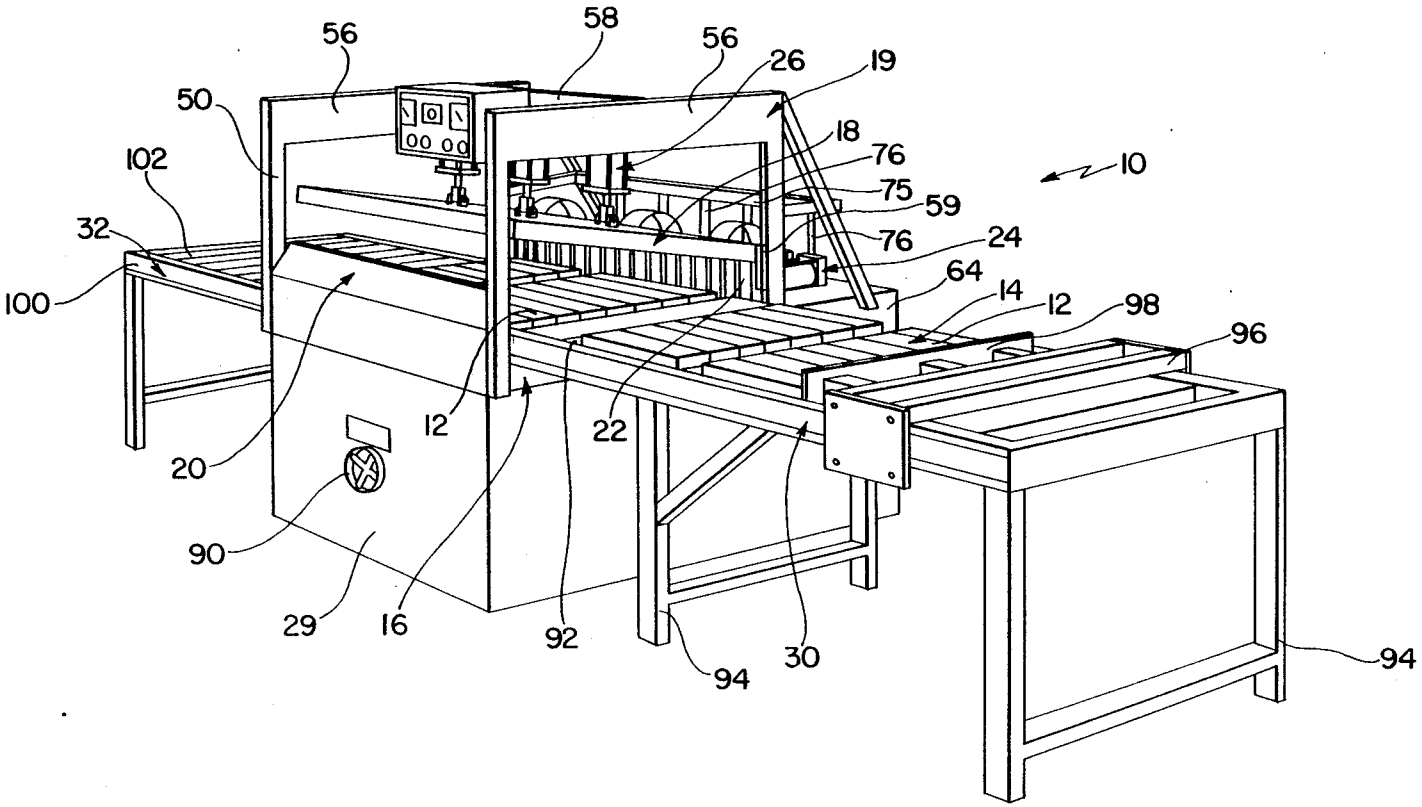
FIG. 1 is a perspective view of the press of the instant invention in combination with a loading table and an outfeed table.

Referring now to the drawings, the press of the instant invention is illustrated and generally indicated at 10 in FIGS. 1 through 4. The press 10 is operative for securing a plurality of workpiece elements 12 in pressurized engagement in substantially coplanar, side-by-side relation during a gluing operation to form composite workpieces, which are also illustrated in FIGS. 1 through 4 and are generally indicated at 14. The press 10 as herein embodied is a press of the type which includes means for generating high-frequency radio waves to effect rapid curing of glues during gluing operations, although it will be understood that other embodiments of the press which do not include means for accelerating the curing of glues are contemplated.

The press 10 comprises a bed generally indicated at 16, a top platen generally indicated at 18, a platen mounting assembly generally indicated at 19, an abutment or retaining wall generally indicated at 20, a plurality of pusher shoes 22, a pusher-shoe mounting and drive assembly generally indicated at 24, a control unit 25, and a plurality of top platen piston assemblies generally indicated at 26. The pusher shoes 22 are mounted on the apparatus 10 adjacent a first edge 27 of the bed 16, and the retaining wall 20 is disposed adjacent an opposite second edge 28 of the bed 16. The pusher shoes 22 are mounted in the mounting and drive assembly 24 so that they are movable along the bed surface toward and away from the wall 20, and the mounting and drive assembly 24, which is controllable by means of the control unit 25, is operative for applying forces to the pusher shoes 22 to urge them toward the wall 20. The platen 18 is hingeably attached in the device 10 so that it is movable to an operative position wherein it is in substantially parallel spaced relation to the upper surface of the bed 16, and the top platen piston assemblied 26, which are also controllable by means of the control unit 25, are operative for urging the platen 18 toward the bed 16. The apparatus 10 as herein embodied further comprises a base 29 on which the bed 16 is mounted, and it is utilized in combination with a loading table generally indicated at 30 on which the workpiece elements 12 are fed to the apparatus 10, and an outfeed table generally indicated at 32.

For use and operation of the apparatus 10, a plurality of the workpiece elements 12 are received on the bed 16 so they are substantially parallel to the wall 20, and the control unit 25 is operated so that the top platen piston assemblies 26 urge the top platen 18 toward the bed 16 to compress the workpiece elements 12 therebetween. Simultaneously, the pusher shoe mounting and drive assembly 24 is operated by means of the control unit 25 to urge the pusher shoes 22 toward the retaining wall 20 so that they engage the rearmost workpiece element 12 to urge the elements 12 into pressurized engagement in substantially side-by-side relation in the apparatus 10. In this regard, the pusher shoes 22 and the top platen 18 are dimensioned and configured so that the pusher shoes 22 are receivable in interfitting relation with the top platen 18 along the rear edge thereof in a manner which will hereinafter be more fully described. As a result of this interfitting relationship, the apparatus 10 is operative for simultaneously applying substantially downward pressures to the elements 12 with the top platen 18 and substantially lateral pressures to the elements 12 with the pusher shoes 22 to secure the elements 12 in pressurized engagement in substantially coplanar, side-by-side relation on the bed 16.

The bed 16 is preferably made in a relatively durable construction from a suitable metal, such as steel, and it is formed with a substantially planar upper bed surface 34 thereon for receiving the workpiece elements 12. The bed 16 may also be provided with a gluing surface sheet (not shown) of Lexan (General Electric TM) or some other suitable material on the surface 34 for facilitating the removal of excess glues and adhesives therefrom, as is generally known in the art.

Figure 4:
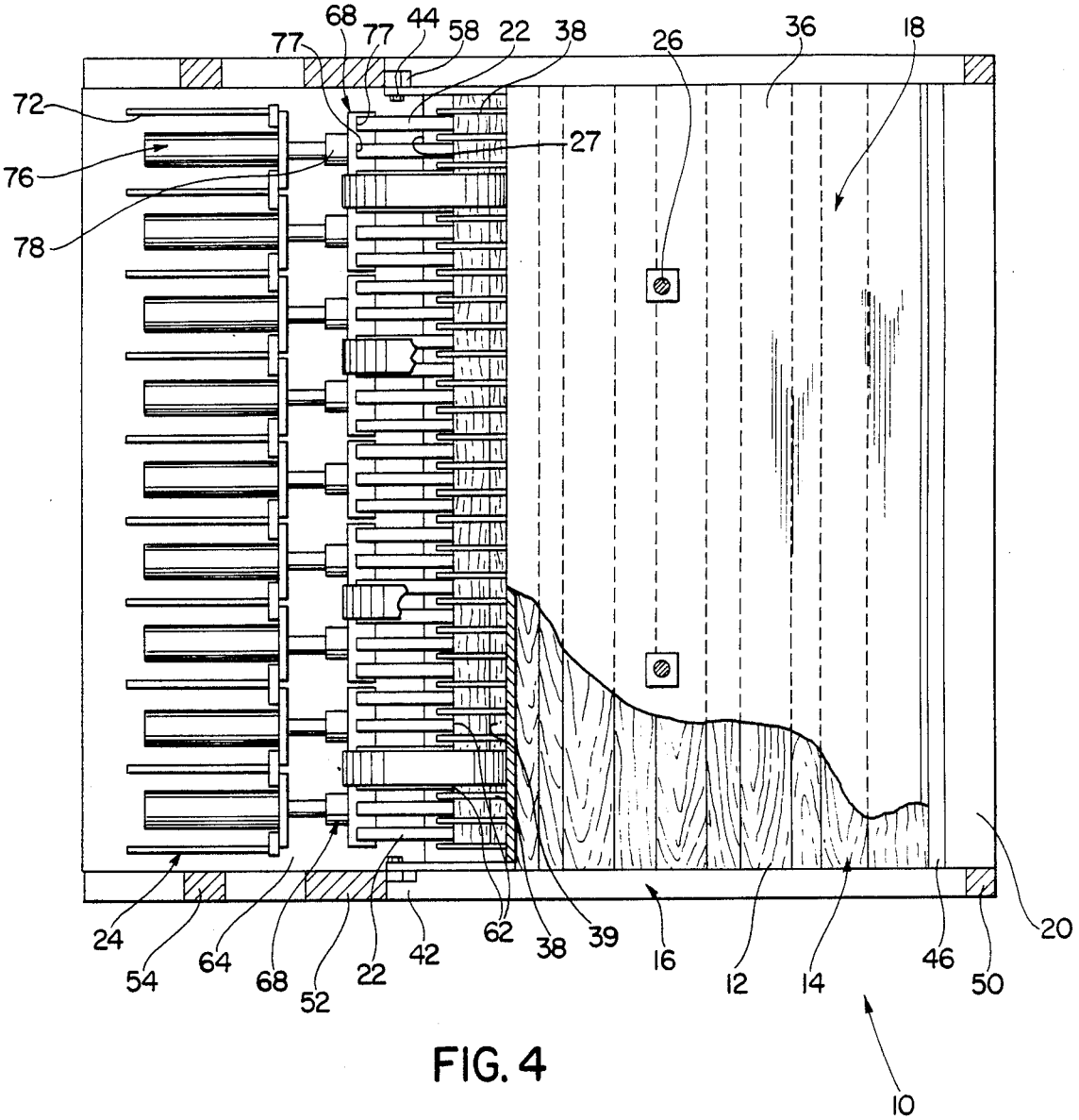
FIG. 4 is a sectional view taken along line 4—4 in FIG. 3.

The top platen 18, which is most clearly illustrated in FIGS. 2 through 4, is also preferably formed in a relatively durable construction from a suitable metal, such as steel, and it comprises a substantially rectangular main platen portion 36 and a plurality of platen fingers 38 which extend integrally in substantially parallel, spaced relation from the rear edge of the main portion 36 and define slots 39 therebetween. The top platen 18 is formed with a substantially planar platen surface 40 thereon which extends across the main portion 36 and the fingers 38, and which may also be provided with a surface layer (not shown) of Lexan (General Electric TM) or some other suitable material. Projecting rearwardly from the opposite sides of the platen 18 are mounting arms 42 from which mounting shafts 44 extend outwardly for pivotally mounting the top platen 18 on the platen mounting assembly 19 in a manner which will hereinafter be more fully set forth. The forward edge of the top platen 18 is provided with a resilient arcuate beryllium copper end cap 46 which is engageable with the retaining wall 20 for grounding the top platen 18, and a plurality of resilient arcuate beryllium copper straps 48 extend rearwardly from the rear periphery of the top platen 18 to the pusher shoe mounting and drive assembly 24 for further electrically grounding the top platen 18.

The platen mounting assembly 19 comprises a pair of spaced front members 50 which extend upwardly from the base 29 adjacent the forward corners of the bed 16, a pair of rear members 52 which extend upwardly from the base 29 adjacent the rear corners of the bed 16, a pair of rear support members 54 which extend angularly upwardly from the rear corners of the base 29 to the upper ends of the rear members 52, a pair of upper horizontal members 56 which extend between the vertical members 52 and 54 on the opposite sides of the apparatus 10, and a center cross member 58 which extends between the two horizontal members 56. The members 50, 52, 54, 56 and 58 are preferably made of a suitable rigid metal, such as steel, in a durable construction so that they cooperate to provide a rigid framework for mounting the platen 18 and the platen piston assemblies 26. The platen mounting assembly 19 further includes a pair of platen pivot brackets 59 which are secured to the forward sides of the vertical members 52 adjacent the lower ends thereof and define substantially vertical slots 60 for pivotally mounting the platen 18 on the mounting assembly 19. More specifically, the shafts 44 are received in the slots 60 so that the shafts 44 are rotatable therein to pivot the top platen 18 but so that the shafts 44 are also vertically movable therein to adjust the vertical position of the rear portion of the platen 18.

The retaining wall 20 is attached to the bed 16 and it extends upwardly adjacent the forward or second edge 28 thereof to provide an abutment along the forward extremity of the bed surface 34. The retaining wall 20 is also preferably made in a rigid construction so that it does not yield when the workpiece elements 12 are forced thereagainst by the pusher shoes 22 in a manner which will hereinafter be more fully set forth. It will be understood, however, that other embodiments of the press of the instant invention which include pusher shoes along the second edge 28 instead of the retaining wall 20 for applying additional pressures to the elements 12 are contemplated. Further, in this regard, other embodiments of the press which include pusher shoes along additional edges of the bed 16 are also contemplated. Obviously, when the press is embodied with pusher shoes mounted along additional edges of the bed, corresponding platen fingers must be provided along corresponding edges of the platen.

The pusher shoes 22 are illustrated most clearly in FIGS. 2, 3 and 4 and preferably comprise substantially vertically disposed elements which are preferably of substantially rectangular configuration, and they preferably have substantially flat vertically disposed work faces 62 thereon which face generally towards the retaining wall 20. The shoes 22 are mounted in the apparatus 10 adjacent the rear bed edge 27 with the pusher shoe mounting and drive assembly 24 so that the shoes 22 travel along the upper bed surface 34 toward and away from the wall 20. Further, the shoes 22 are dimensioned and oriented so that they are receivable between the top platen fingers 38, as illustrated most clearly in FIG. 4 to permit the shoes 22 to be moved inwardly distances along the bed surface 34 toward the wall 20 when the top platen 18 is in a lowered or operative disposition wherein the top platen surface 40 is in substantially parallel, relatively closely spaced relation to the bed surface 34, as illustrated in FIGS. 3 and 4. The shoes 22 are preferably constructed of a relatively hard, durable, electrically nonconductive material, such as a phenolic compound, so that they do not short circuit between the bed 16 and the platen 18 when the radio frequency generation apparatus of the press is energized, and they are preferably dimensioned and mounted so that they can travel in substantially the entire extents of the slots 39 between the fingers 38.

The pusher shoe mounting and drive assembly 24 is also illustrated most clearly in FIGS. 2, 3 and 4. It comprises a rear mounting shelf 64, a plurality of piston assemblies generally indicated at 66, and a plurality of pusher shoe heads generally indicated at 68. The shelf 64 extends rearwardly from the bed 16 in downwardly spaced relation to the plane of the bed surface 34, and it is supported by the base 29. The piston assemblies 66 comprise hydraulic cylinders 70 which are mounted in gusset brackets 72, and piston rods 74 which extend from the cylinders and are connected to the pusher shoe heads 68. The piston assemblies 66 are connected to a hydraulic supply manifold 75 through hydraulic lines 76 for supplying hydraulic fluid to the cylinders 70. The gusset brackets 72 are mounted on the shelf 64, and the cylinders 70 are preferably mounted in the brackets 72 so that the piston rods 74 travel in substantially parallel relation to the bed surface 34. The pusher shoe heads 68 are each adapted for mounting a plurality of pusher shoes 22 (three in the embodiment herein set forth) and for maintaining the shoes 22 in substantially vertical orientations so that they are slidably receivable in the slots 39 between the fingers 38. In this regard, the heads 68 are formed with substantially parallel, vertically disposed channels 77 therein for snugly receiving the shoes 22, and sockets 78 are formed on the heads 68 for connection thereof to the respective piston rods 74. Also formed on the heads 68 are support plates 80 which extend downwardly so that they ride on the shelf 64 to maintain the shoes 22 in substantially level disposition on the bed surface 24 and to prevent the heads 68 from rotating. Preferably, the cylinders 70 are constructed so that they prevent the shoes 22 from engaging the inner extremities of the slots 39 between the shoes 38 to prevent damage to the faces 62 of the pusher shoes 22.

The control unit 25 is mounted on the cross member 58 and it comprises a conventional control apparatus which is generally known in the art and which is operative for performing the functions herein described.

The platen piston assemblies 26 are mounted on the cross member 58, and they are connected to the platen 18 for effecting the raising and lowering thereof and also for urging the platen 18 toward the bed surface 34. Preferably the apparatus 10 comprises at least two of the assemblies 26, and they are preferably disposed in spaced relation so that they are operative for applying substantially even downward pressures to the platen 18 to urge it toward the surface 34. The platen piston assemblies 26 preferably each comprise a hydraulic cylinder 82 which is connected to a supply of pressurized hydraulic fluid through hydraulic lines 84, and a piston rod 86 which is pivotally attached to the platen 18 as at 88. The piston assemblies 26 are operative as conventional hydraulic piston assemblies for raising and lowering the platen 18 in a conventional manner.

The base 29 is preferably of a conventional construction and it provides a supporting structure for the operative components of the apparatus 10. In the embodiment herein set forth, the base 29 also provides a housing for conventional radio-frequency wave generation equipment which is operative for producing high-frequency radio waves to effect rapid curing of glues utilized for securing the work piece elements 12 together in the press 10. The radio-frequency wave generation equipment, which does not comprise part of the instant invention, is controlled by a rotatable wheel control 90 mounted on the front of the base 29, and it is internally electrically connected to the bed 16 and electrically connected to the top platen 18 through the beryllium copper bands 48 and cap 46.

The loading table 30 which is also not part of the instant invention comprises a conventional loading table having an upper bed surface 92 and a supporting table structure 94. The table 30 is connected to the bed 16 so that the upper surface 92 provides a substantially coplanar extension of the bed surface 34. The table 30 further comprises a pusher 96 which is slidably mounted in the table 30 to travel longitudinally along the upper surface 92 thereof. The pusher 96 comprises a pusher face plate 98 which is engageable with workpiece elements 12 disposed on the table surface 92 for advancing them toward the bed 16. Preferably the pusher 96 is driven by a chain-drive mechanism (not shown) for longitudinally moving it along the upper table surface 92 to effect advancement of the workpiece elements 12.

The outfeed table 32, which also does not comprise part of the instant invention, is preferably of conventional construction and it comprises a supporting table structure 100 and a plurality of idler rollers 102 for slidably receiving composite workpieces 14 on the table 32 after the workpiece elements 12 have been glued together in the press 10. The table 32 is preferably also connected to the bed 16, and the rollers 102 are preferably disposed at substantially the same level as the bed surface 34.

For use and operation of the press 10, an uncured glue or adhesive is applied to the side edges of a plurality of the workpiece elements 12, and the elements 12 are positioned on the loading table 30 so that they are substantially parallel to the wall 12 and in substantially side-by-side engaging relation with the adhesive interposed therebetween and so that they cooperate to define a composite workpiece 14. The workpiece elements 12 are then advanced by the pusher 96 onto the bed 16. The control apparatus 25 is then operated to actuate the platen piston assemblies 26 so that they move the platen 18 downwardly into engagement with the workpiece elements 12 so that the workpiece elements 12 are, in effect, compressed between the platen 18 and the bed 16. In this regard, preferably all of the workpiece elements 12 in a particular pressing operation are of substantially the same thickness so that the platen 18 can effectively engage all of the elements 12 to simultaneously urge them all toward the bed 16. Further, because the platen 18 is mounted with the shafts 44 received in the slots 60 in the brackets 59, the platen 18 is pivotable, but the position of the rear portion of the platen 18 can nevertheless be vertically adjusted to that the platen surface 40 can be maintained in substantially parallel relation to the bed surface 34 regardless of the thickness of the workpiece elements 12. This permits even pressures to be applied to the work piece elements 12 by the platen 18. After the platen 18 has been moved into a position of pressurized engagement with the workpiece elements 12, the control apparatus 25 is operated to actuate the pusher shoe pistons 70 to advance the pusher shoes 22 forwardly on the bed surface 34 toward the wall 20 so that they are received in the slots 39 between the platen fingers 38 and so that the workpiece elements 12 are thereby urged into pressurized engagement with each other between the shoes 22 and the retaining wall 20. In this regard, in the application of the apparatus of the instant invention illustrated in the drawing, the composite workpiece 14 is dimensioned so that when the forwardmost workpiece element 12 thereof is in engagement with the wall 20 and the top platen 18 is in its lowered position wherein it is in engagement with the workpiece elements 12, the rear edge of the rearmost workpiece element 12 of the composite workpiece 14 is disposed beneath the fingers 38 at intermediate points in the extents thereof. As a result, when the shoes 22 are partially received in the slots 39, they engage the rearmost workpiece element 12 to urge it forwardly and thereby urge all of the elements 12 into pressurized engagement with each other. In cases where composite workpieces having shorter rearward extents are compressed in the apparatus 10, one or more spacer blocks (not shown) may be utilized in front of or in back of the workpiece elements 12 on the surface 34 so that the elements 12 can be secured in pressurized engagement. In any case, after the pusher shoes 22 have been actuated to urge the workpiece elements 12 into pressurized engagement with each other, preferably the platen piston assemblies 26 are instantaneously deactuated in a "breathing cycle" in a manner generally known in the art in connection with the heretofore known presses to allow the pusher shoes 22 to urge the elements 12 into more complete pressurized engagement with each other without disturbing their substantially coplanar positions. After the piston assemblies 26 have been instantaneously deactuated, they are again fully actuated so that the workpiece elements 12 are secured in the apparatus 10 in pressurized engagement in substantially side-by-side coplanar relation. The radio-frequency wave generation apparatus contained in the housing 28 is then actuated to effect rapid curing of the glue between the workpiece elements 12 in a conventional manner to permanently secure the workpiece elements 12 in a position wherein they permanently define the composite workpiece 14. After the glue has been cured, the radio wave generation apparatus is deactivated, the piston assemblies 26 and 66 are deactuated, and the composite workpiece 14 is moved onto the outfeed table 32.

It is seen, therefore, that the instant invention provides an effective press which is operative during a gluing operation for securing a plurality of workpiece elements of substantially the same thickness in a composite position wherein adjacent workpiece elements are in pressurized engagement in substantially side-by-side, coplanar relation. The pusher shoes 22 are receivable in the slots 39 between the platen fingers 38 so that pressures can be simultaneously applied to the workpiece elements 12 with the shoes 22 and with the platen 18. Further, the shoes 22 are permanently mounted in the press 10, and they do not require adjustments when workpiece elements 12 of a different thickness are clamped between the platen 18 in the bed 16. The press 10 eliminates the necessity for maintaining an inventory of removable pusher shoes of the type utilized in the heretofore-known apparatus, and it also eliminates the necessity for many of the adjustment procedures required by the previously known pressing apparatus. Further, the pusher shoes 22 can be relied upon to provide even clamping pressures along the substantially flat working faces 62 thereof to provide greater uniformity and precision in clamping operations. Hence, for these reasons, as well as the other reasons hereinabove set forth, it is seen that the press of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A press for securing a plurality of workpiece elements of substantially the same thickness in pressurized engagement during a gluing operation in substantially side-by-side, coplanar relation to define a composite workpiece, said press comprising:

a. a bed having a substantially flat bed surface thereon, said bed surface having a pair of spaced substantially opposite edges;

b. a plurality of spaced pusher shoes mounted adjacent a first of said edges and movable toward the second of said edges;

c. means for urging said pusher shoes toward said bed surface second edge;

d. means for retaining said workpiece elements on said bed surface against movement toward said bed surface second edge;

e. a platen attached to said press having a main portion and a plurality of platen fingers which extend from said main portion in substantially parallel spaced relation for receiving said pusher shoes therebetween, said platen having a substantially flat platen surface thereon which extends across said main portion and said fingers, and being positionable in an operative position wherein said platen surface is in substantially parallel, face-to-face spaced relation with said bed surface and wherein said pusher shoes are receivable between said fingers;

f. means for urging said platen toward said bed surface when said platen is in the operative position thereof; and g. whereby when said workpiece elements are disposed and oriented in said composite position so that at least one of said workpiece elements is in communication with said retaining means so that said pusher shoes are receivable in communication with another of said workpiece elements, and so that forces applied to said elements by said pusher shoes and said retaining means urge said elements together, said workpiece elements are secured in pressurized engagement in said composite position when said platen is in the operative position thereof and said platen urging means and said pusher shoe urging means are actuated.

2. In the press of claim 1, said pusher shoes traveling substantially along the surface of said bed.

3. In the press of claim 1, said pusher shoes having substantially flat working faces on the inner edges thereof, said faces being substantially perpendicular to said bed surface.

4. In the apparatus of claim 1, said pusher shoe urging means further characterized as a plurality of pusher shoe urging assemblies which are operable in substantially parallel relation for urging different pusher shoes.

5. In the apparatus of claim 1, said platen being hingeable between said operative position and an inoperative position wherein it is disengaged from said workpiece elements, it is disposed in angular relation to said bed surface, and said shoes are substantially removed from between said fingers.

* * * * *